US005460851A

United States Patent [19]

Jenkins

[11] Patent Number: 5,460,851

[45] Date of Patent: Oct. 24, 1995

[54] SPRAY DEPOSITION OF METALS

[75] Inventor: Walter N. Jenkins, Swansea, Great Britain

[73] Assignee: Sprayforming Developments Limited, Swansea, Great Britain

[21] Appl. No.: 937,850

[22] PCT Filed: Apr. 18, 1991

[86] PCT No.: PCT/GB91/00606

§ 371 Date: Nov. 12, 1992

§ 102(e) Date: Nov. 12, 1992

[87] PCT Pub. No.: WO91/16471

PCT Pub. Date: Oct. 31, 1991

[30] Foreign Application Priority Data

Apr. 8, 1990 [GB] United Kingdom ..... 9008703

[51] Int. Cl.[6] ..... B05D 5/00; B05D 1/12; B05B 17/04

[52] U.S. Cl. ..... 427/199; 427/422; 239/1; 239/11; 239/293; 239/300; 239/301; 118/300; 118/323; 118/706

[58] Field of Search ..... 118/300, 302, 118/308, 665, 679, 688, 712, 706, 323; 427/455, 349, 199, 348; 239/301, 290, 291, 292, 293, 295, 296, 297, 298, 300, 1, 11; 264/12

[56] References Cited

U.S. PATENT DOCUMENTS

| | | | |
|---|---|---|---|
| 1,608,833 | 11/1926 | Birkenmaier et al. | 239/298 |
| 1,752,922 | 4/1930 | Mueller | 239/301 X |
| 1,752,923 | 4/1930 | Mueller | 239/292 |
| 1,760,373 | 5/1930 | Perrin | 239/301 |
| 2,177,851 | 10/1939 | Wallace | 239/293 |
| 3,013,528 | 12/1961 | Bland . | |
| 4,308,996 | 1/1982 | Rotolico | 239/301 X |
| 4,334,495 | 6/1982 | Derkacs et al. . | |
| 4,358,471 | 11/1982 | Derkacs et al. . | |
| 4,411,940 | 10/1983 | Derkacs et al. . | |
| 4,485,834 | 12/1984 | Grant . | |
| 4,647,471 | 3/1987 | Jenkins | 118/300 X |
| 4,720,044 | 1/1988 | Stemwedel, Jr. | 239/290 X |
| 4,905,899 | 3/1990 | Coombs et al. | 239/292 X |
| 5,201,466 | 4/1993 | Hynds | 239/296 X |
| 5,242,110 | 9/1993 | Riley | 239/297 X |

FOREIGN PATENT DOCUMENTS

| | | | |
|---|---|---|---|
| 1000078 | 2/1988 | Belgium . | |
| 0007207 | 1/1980 | European Pat. Off. . | |
| 1170552 | 1/1959 | France . | |
| 0010553 | 3/1986 | Japan | 118/688 |
| 1431855 | 10/1988 | U.S.S.R. | 239/301 |
| 1455862 | 11/1976 | United Kingdom . | |
| 12116 | 12/1989 | WIPO . | |

*Primary Examiner*—David A. Simmons
*Assistant Examiner*—M. Curtis Mayes
*Attorney, Agent, or Firm*—Cooper & Dunham

[57] ABSTRACT

A method for the spray distribution of metals includes emitting a stream of molten metal particles and a gas nozzle which is rotated about the stream. The gas nozzle is inclined to the axis of the particle stream and in the direction of the stream in order to produce a required distribution of the particle stream on a workpiece.

2 Claims, 5 Drawing Sheets

SPRAY DEPOSITION OF METALS

Figure 1:
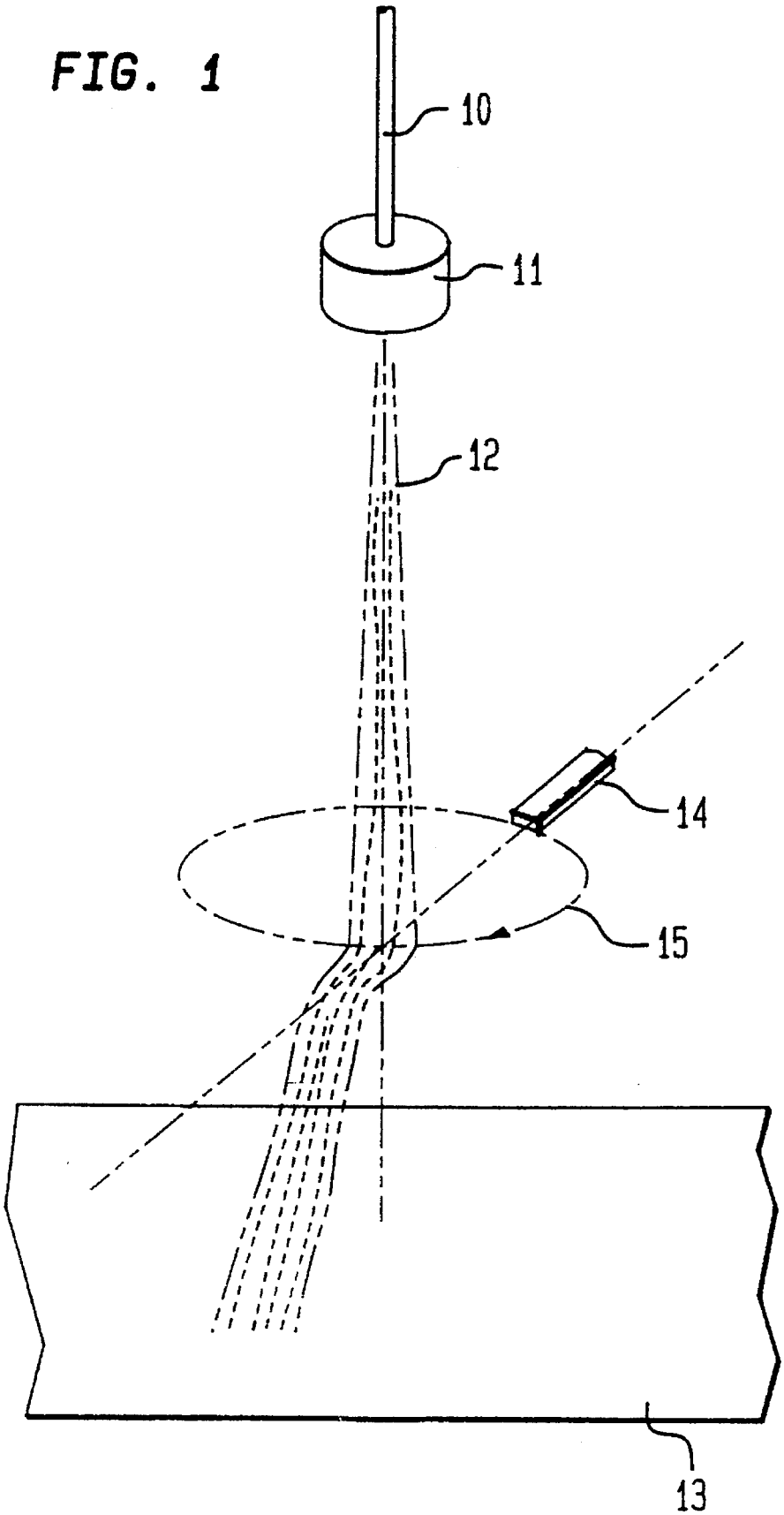

This invention relates to the spray deposition of metals.

The spray deposition of metals is being used increasingly for making a wide range of semi-finished metal products because of the technical benefits that accrue. These benefits include near-to-zero segregation, a very fine structure caused by rapid solidification, high mechanical properties and a short route to the product. The generic name for the whole group of such processes is spray forming. This invention is more particularly concerned with movement of the spray by deflecting an atomized stream of molten metal particles and directing them on to a stationary or moving substrate.

According to this invention apparatus there is provided apparatus for spray distribution of metals comprising means for emitting a stream of atomized molten metal particles, characterized in that the means for emitting a stream of atomized molten metal particles is arranged to emit said stream in a predetermined direction, and in that there are provided gas jet nozzle means mounted for rotation about said stream for laterally deflecting said stream, which nozzle means is inclined to the direction of flow of the stream and is directed towards the stream, and means for supplying deflecting gas under pressure to said nozzle means.

Preferably said nozzle means is mounted for rotation about the axis of said stream of particles.

The pressure of said atomizing gas is preferably adjustable to vary the extent of deflection of the stream of metal particles.

The apparatus may further comprise a second gas jet nozzle means mounted for rotation about said stream of metal particles, the axes of rotation of the first said nozzle means and said second nozzle means being offset from the axis of the stream of metal particles.

The nozzle means may comprise a plurality of nozzles, the means for supplying deflecting gas under pressure to the nozzle means being operable to vary cyclically the pressure of such gas supplied to one or more of the nozzles.

Said means for supplying deflective gas under pressure to said nozzle means may comprise a plurality of nozzles at least one of which is inclined at a different angle to the other or others of the nozzles. In such an arrangement, the pressure of the gas supplied to one of the nozzles by said means for supplying gas under pressure to the nozzle means may be different from that supplied to another of the nozzles.

The stream may be a compact vertically falling stream of atomized molten metal particles derived from a melt. It will however be understood that other streams of atomized molten metal particles can equally well be used for the application of the invention, such as streams of atomized molten metal particles that are not falling vertically and small diameter streams of atomized molten metal particles from a wire or powder fed arc or thermal spray gun or from a powder fed plasma source.

The atomized stream of molten metal particles may contain smaller particles that are partly liquid and partly solid. It may also contain some other small particles that are already solid because of the very rapid cooling of such small particles in the atomizing gas stream. The operation of the invention is not affected by this variation in the thermal history of the particles.

The deflecting nozzle means may comprise a nozzle or group of nozzles, and will usually have an orifice which is circular for convenience of manufacture but which may be rectangular in cross section or take the form of a slot. The nozzles of a deflecting group of nozzles may be parallel to one another, may be directed towards the stream of atomized metal particles, or may have an intermediate direction and be operated sequentially.

Primary atomization providing a vertically falling stream of atomized molten metal particles may be achieved by any one of many conventional gas atomizing nozzles but the stream of atomized particles should preferably be symmetrical about an axis and be relatively compact to enable it to be effectively deflected by the gas jets.

The substrate or collector towards which the stream is directed may be stationary, rotating, moving generally or moving in a linear manner. Continuous linear movement of a substrate in one direction at right angles to the axis of the primary atomised metal stream will produce a strip. A collector that is moving slowly at a controlled rate in the direction of the axis of the primary metal stream but away from the atomizer, may be used to produce a circular billet form if a feedback to the deflecting jets operated either manually and visually or automatically enables a relatively flat top profile to be maintained. A circular collector that is moving slowly at a controlled rate in the direction of the axis of the primary metal stream away from the atomizer and is surrounded by a stationary or reciprocating circular mould wall may be used to produce a billet continuously if a type of control is used similar to that described above.

Although movement of the spray is desirable for the production of many shaped products, the product that causes most problems and is required most frequently is the continuous spray forming of a flat metal strip. The special difficulty in the case of continuous spray forming of strip is that the thickness profile across the width must meet very strict tolerances in order for it subsequently to be hot or cold rolled. A further limitation is that overspray, i.e. that portion of the spray that does not form part of the product lying within the strict tolerance band, is kept to a minimum in order to ensure an ecomomic and cost effective process.

Many procedures have been devised to overcome the problem, the most commonly used being mechanical or pneumatic scanning in a direction across the width of the strip. Mechanical scanning devices suffer from difficulties caused by the inertia of the system when oscillating devices are used leading to greater dwell time at the edges of the strip and consequent thickening in these areas when operated rapidly. Pneumatic systems have no such limitation but it is difficult to keep overspray down to an economic level. The present invention overcomes both of these problems and has the additional advantage of spreading deposition along the pass line when flow rates are high.

In the case of manufacturing flat strip continuously the invention is employed to modify the thickness profile of the spray from a gas atomiser, so as to produce a substantially uniform deposit across a flat substrate advancing at uniform speed under the spray.

Figure 2:
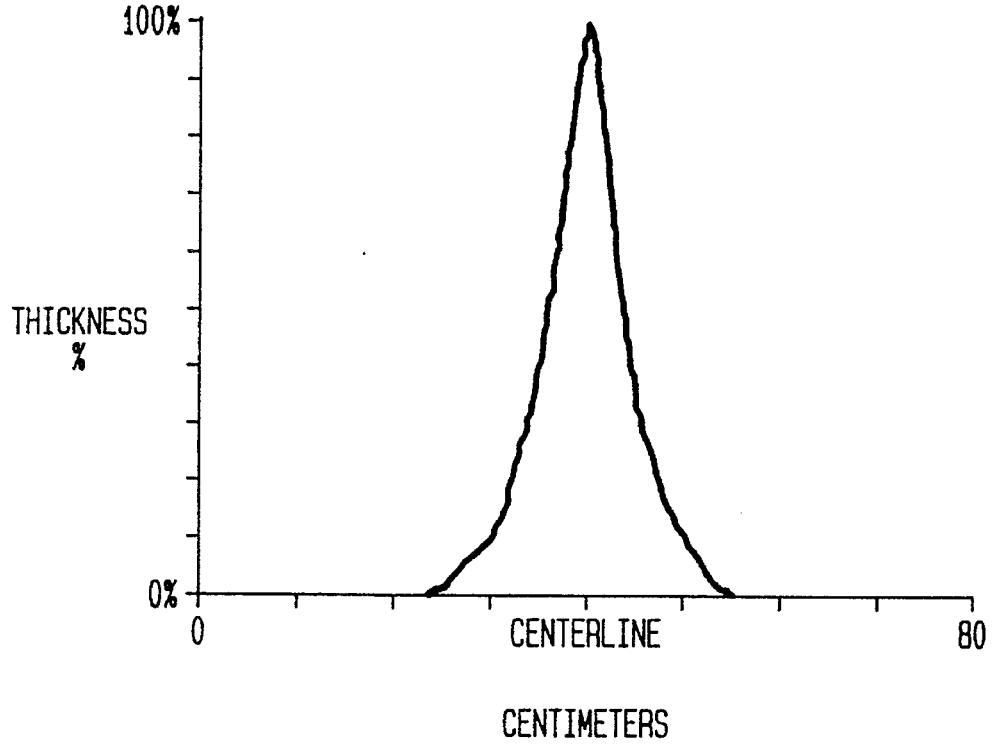
Figure 3:
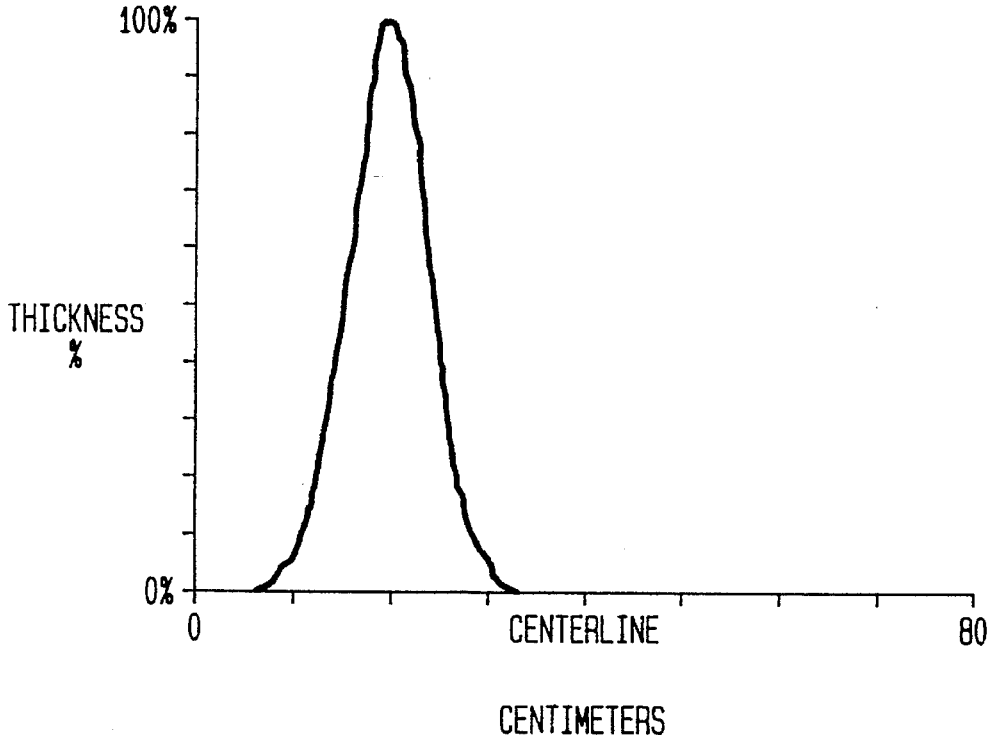
Figure 4:
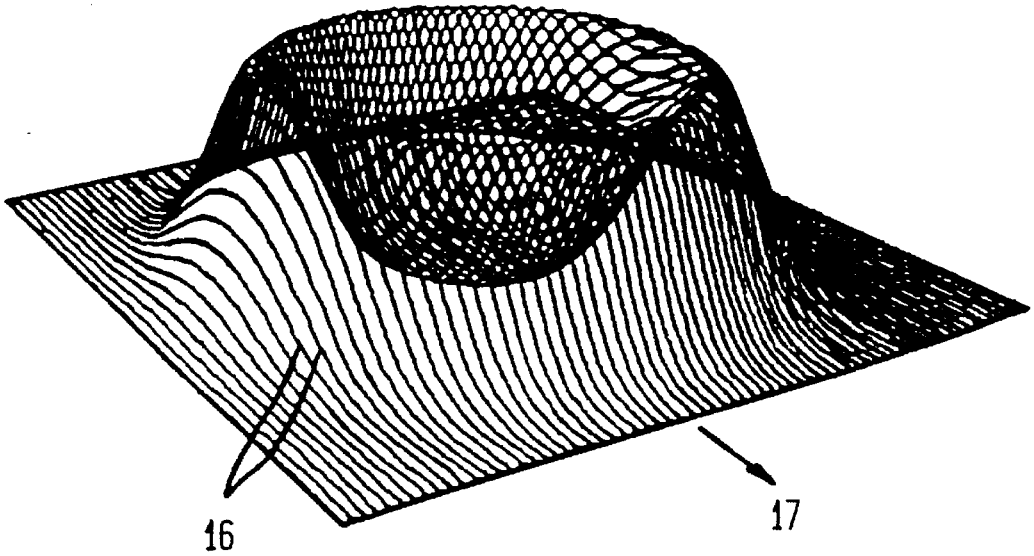
Figure 7:
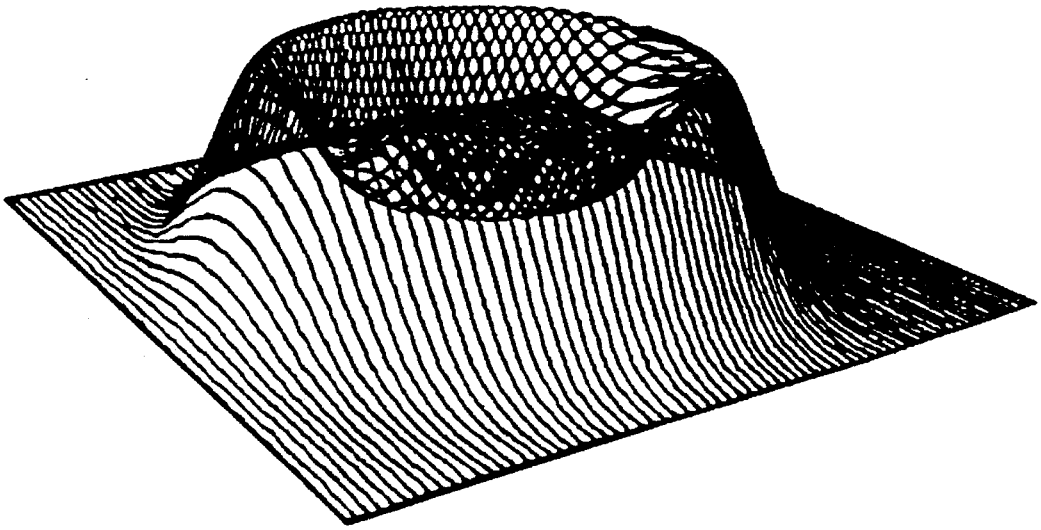
Figure 5:
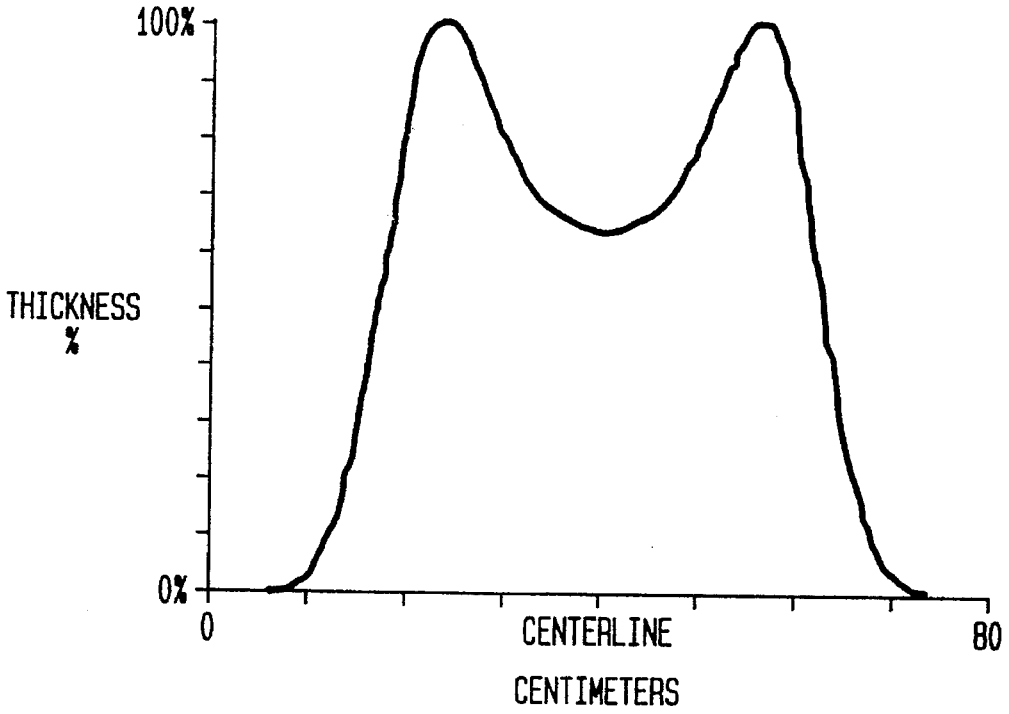
Figure 6:
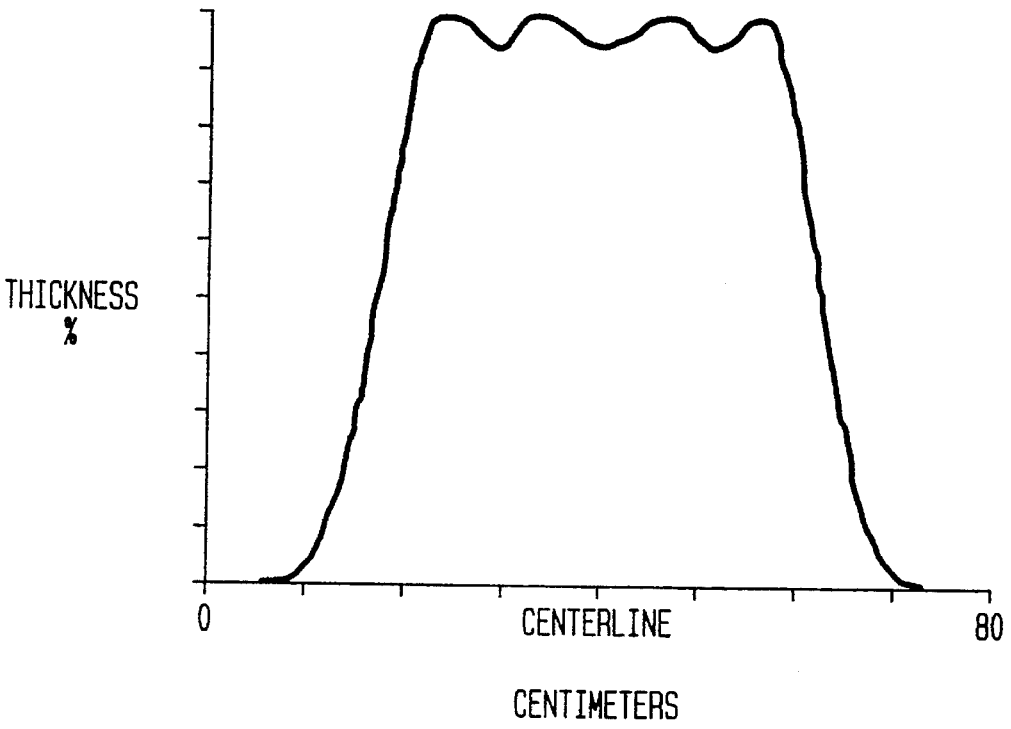
Figure 8:
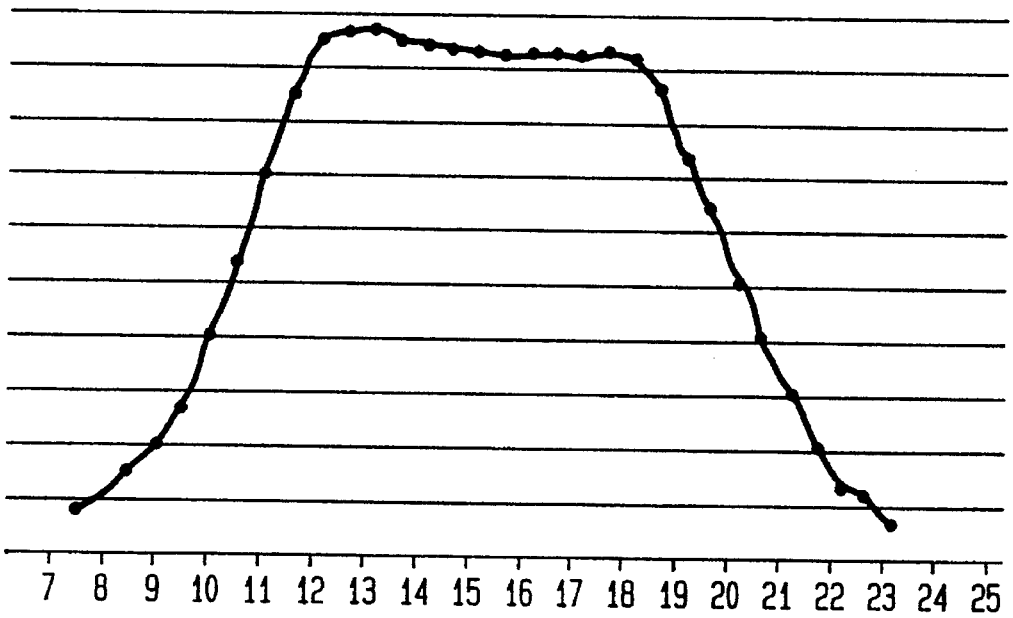

The invention will now be further described with reference to the accompanying drawings in which:

FIG. 1 shows diagrammatically an apparatus according to the invention,

FIGS. 2 and 3 diagrammatically illustrate respectively the thickness profile of an undeflected stream of atomized metal particles and the generating thickness profile of the stream when the thickness profile of FIG. 1 is deflected laterally, FIG. 4 illustrates diagrammatically the result of deflecting a stream of particles by a gas nozzle rotating about the axis of the stream and collecting the particles on a stationary substrate, FIGS. 5 to 7 show diagrammatically the effects of modifications in the distribution shown in FIG. 4, and FIG. 8 illustrates diagrammatically an experimental profile achieved by an apparatus according to the invention.

Referring to FIG. 1 of the drawings, a stream 10 of molten metal is passed through a primary atomizer 11 and is directed as an atomized stream 12 towards a collector or substrate 13. A deflecting gas jet is emitted from a group of parallel nozzles 14 which is inclined downward, at say 30° to the horizontal, and towards the axis of the stream 12 and which is mounted on a rotor (not shown) for rotation in a circular path 15 centred on the axis of the stream 12.

When undeflected the atomizer 11 produces a stream of particles which is symmetrical about a central axis and which has a thickness profile as illustrated diagrammatically in FIG. 2.

FIG. 3 shows an experimentally derived thickness profile of a deposit that is typically formed on a substrate 12 which is stationary when the deflecting jet is held stationary and the undeflected profile is as in FIG. 2. It is to be noted that the deposit is deflected to peak at 200 mm from the centreline of the device. The profile produced with a non-rotating deflecting jet will be referred to as the "generating profile".

The effect of controlling the pressures and direction of the deflecting jets during rotation of the rotor is best shown by a computer simulation which follows closely experimentally derived values. FIG. 4 shows a computer generated perspective view of the deposit which might be formed on a stationary substrate with the above generating a profile, which the deflecting jet is effectively rotating. The vertical ordinate represents the thickness of deposit, and has been exaggerated in order to illustrate the topography of the deposit; in practice the thickness would usually be in the strip or slab range of thickness, of 2–10 mm whereas the diameter of the deposit could be as much as 1 metre.

The vertical ordinate also represents, on a suitable scale, the spray density or flow rate per unit area impingeing on a substrate advancing at constant speed towards the observer in the direction of the arrow 16 in FIG. 4. The accumulation of deposit on any element of width as it passes through the spray is therefore proportional to the volume of the parallel vertical slice which contains the same element of width. The demarcation lines 17 between slices are shown in FIG. 4.

FIG. 5 is a computer generated plot across the width of the substrate, of the volume of small vertical slices of equal thickness through the deposit of FIG. 4, and it also represents, on a suitable scale, the thickness profile of a deposit which would be formed on a substrate traversing the spray at constant speed. The computer plot predicts a central trough and this is confirmed by practical experimental observations on the deposition of metals under these conditions. The trough is unacceptable for the making of strip and sheet,and can be filled in by cyclically applying gas under different pressures to the deflecting jet after a predetermined number of revolutions of the rotor. Thus FIG. 6 is the profile which would be expected on a moving substrate, with the generating profile of FIG. 3, when the deflecting jet pressure is lowered during every fourth revolution. The corresponding perspective view of a deposit on a stationary substrate is shown in FIG. 7.

In an alternative procedure to fill in the trough, two or more deflecting jets are provided on the rotor and would be inclined at different angles to the horizontal. For example, a second, centre-filling jet would be inclined downwards at a greater angie than the main deflecting jet.

Another possibility for trough filling would be to employ two rotary deflecting jets along the same longitudinal section, one operating continuously with the generating profile of FIG. 3, and the other continuously with a lower flow rate and with possibly a lower pressure as well.

FIG. 8 illustrates an experimental profile achieved by an apparatus according to the invention.

More than one rotary atomizer may be employed to cover the width of a strip deposit, and in the event of two operating with overlapping profiles, the overspray would be reduced to less than half. The two devices would be mounted at pitch centres appropriate for maintaining, between them a constant thickness in the overlap region.

The apparatuses described above are advantageous in that adjustments to the profile can be made during operation, especially in the case where the speed of the rotor is varied cyclically, by varying the pressure during the low pressure period, and the proportion of the time that the low pressure is applied. Such adjustments can be made within a feedback loop in a system which continuously monitors final thickness profile, using for example a noncontact gauge. The set of rules for minimising profile error could readily be programmed into a microprocessor operating within the loop. Also, the construction is simpler than with other types of scanner, especially with the mechanical oscillator types, which involve large acceleration and deceleration forces. Furthermore, high speed rotation is possible, enabling much higher scanning speeds than is possible with mechanical oscillator types.

We claim:

1. A method of producing a sprayed deposit of metal, the method comprising:

(a) directing a stream of molten metal particles along an axis towards a substrate so as to produce a deposit of said metal on said substrate;

(b) rotating gas jet nozzle means about said axis to laterally deflect said stream of molten metal particles such that said stream describes a circular path about said axis thereby to provide said deposit comprising a peripheral region surrounding a central region, said peripheral region having a greater deposit thickness than the deposit thickness of said central region; and (c) intermittently, at predetermined cyclical intervals, selectively directing a stream of said molten metal particles towards said central region.

2. A method according to claim 11, wherein step (c) is carried out using gas jet nozzle means having a gas pressure which is cyclically varied.

* * * * *